United States Patent [19]

Wilson

[11] 4,055,160

[45] Oct. 25, 1977

[54] TABLE SAW

[76] Inventor: Harry R. Wilson, 1410 Pin Oak Drive, Cedar Falls, Iowa 50613

[21] Appl. No.: 681,448

[22] Filed: Apr. 29, 1976

[51] Int. Cl.[2] ..... B28D 1/04

[52] U.S. Cl. ..... 125/13 SS; 51/268

[58] Field of Search ..... 125/13 R, 13 SS; 51/268; 83/478

[56] References Cited

U.S. PATENT DOCUMENTS

| | | | |
|---|---|---|---|
| 1,411,045 | 3/1922 | Leaver | 83/478 |
| 1,640,517 | 8/1927 | Procknow | 83/478 |
| 2,799,125 | 7/1957 | Dicke | 51/102 |
| 2,972,344 | 2/1961 | Bergen | 125/13 SS |
| 3,034,493 | 5/1962 | Bandy | 125/13 R |

FOREIGN PATENT DOCUMENTS

| | | | |
|---|---|---|---|
| 533,596 | 9/1955 | Italy | 125/13 SS |

*Primary Examiner*—Harold D. Whitehead
*Attorney, Agent, or Firm*—Zarley, McKee, Thomte, Voorhees & Sease

[57] ABSTRACT

A masonry table saw includes a table having an upstanding post on which a saw arm is pivotally mounted with a saw blade on one end and a motor on the opposite end. The motor and saw blade are on opposite sides of the saw arm. Top and bottom blade guards are provided. The top guard is self-levelling and the bottom guard is connected to a foot-operated saw arm linkage for raising the bottom guard as the saw arm is lowered.

16 Claims, 4 Drawing Figures

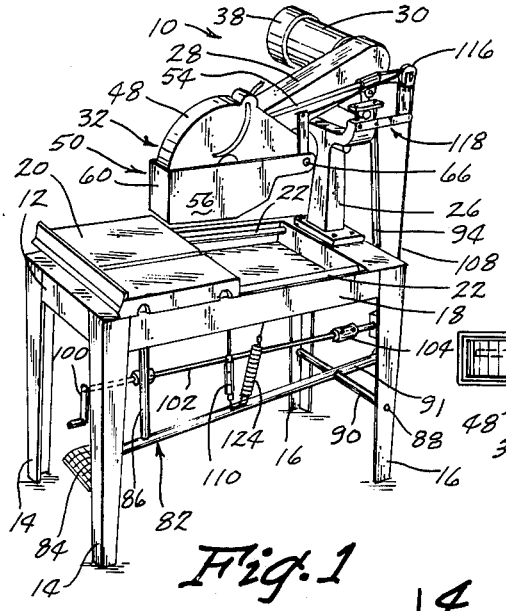
Fig. 1
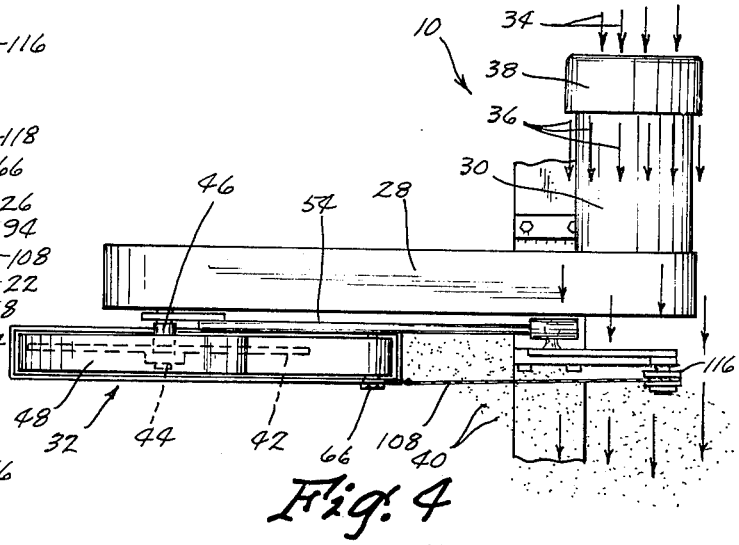
Fig. 4
Fig. 2
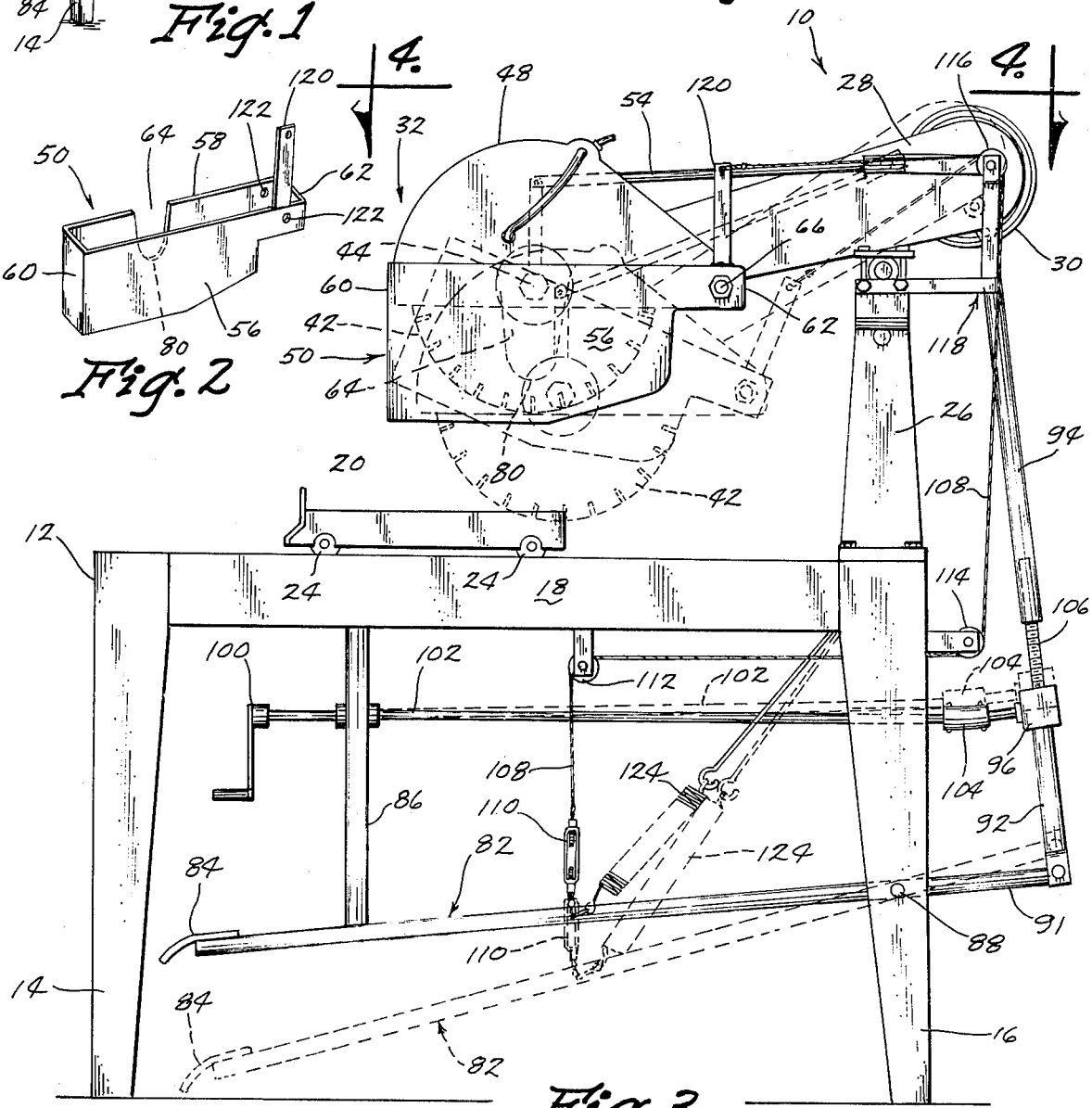
Fig. 3

TABLE SAW

BACKGROUND OF THE INVENTION

Improved safety requirements for operation of saws, including masonry saws, require that the saw blade be guarded as much as possible and particularly when the saw is not cutting a work piece. Heretofore there have been floating-type bottom saw guards that would engage the work piece and rise above it as the saw is moved over the work piece. This kind of a saw guard interfers with the sawing operation and thus an automatically retractable bottom saw guard is desired that does not require contact with the work piece to effect raising and lowering of the saw guard. Further, the motor on saws in commonly damaged by dust from the saw blade being drawn into the motor with cooling air. It is desired that not only fresh air be allowed to enter the motor but that the air exhausted from the motor be utilized in blowing sawdust away from the inlet air openings of the motor.

SUMMARY OF THE INVENTION

The table saw of this invention involved a work table having an upstanding post on which a saw arm is pivotally mounted with the drive motor at one end on one side of the saw arm and the rotating saw blade on the opposite end on the opposite side of the saw arm. The motor is arranged horizontally and perpendicular to the saw arm at the diagonally opposite end from the saw blade and the air inlet openings for the motor are at the outer free end with an annular vane embracing the motor at the outlet openings to direct the exhausted air towards the vertical plane of the saw blade such that sawdust is blown away from the inlet air openings for the motor.

The saw arm includes top and bottom blade guards with the top guard being pivotally mounted for pivotal movement about an axis through the center of the saw blade. The bottom guard is pivotally mounted to the top guard on a horizontal line through the axial center of the saw blade. The top guard is maintained level by linkage connected to the saw arm and the bottom guard is automatically retractable as the saw arm is lowered. Thus the bottom guard and the saw arm move in opposite directions. Foot control linkage is provided under the table and is connected to the saw arm for raising and lowering the saw arm and a cable actuating linkage is connected to the bottom blade guard and to the linkage for the saw arm such that as the saw arm is operated the bottom blade guard moves in the opposite direction whereby the bottom guard is raised as the blade is lowered into the work piece and the bottom guard is lowered as the blade is moved away from the work piece. The bottom saw guard does not contact the work piece.

DESCRIPTION OF THE DRAWINGS

FIG. 1 is a perspective view of the table saw of this invention.

FIG. 2 is a perspective view of the bottom blade guard.

FIG. 3 is a side elevation view of the table saw showing the saw arm and bottom blade guard in raised and lowered positions.

FIG. 4 is a top plan view taken along line 4 - 4 in FIG. 3.

DESCRIPTION OF THE PREFERRED EMBODIMENT

The table saw of this invention is referred to generally in FIG. 1 by reference numeral 10 and includes a table 12 having legs 14 and 16 supporting a top 18 on which a movable table 20 is positioned for supporting a work piece (not shown). V-shaped rails 22 are provided on which wheels 24 roll.

The top of the table 12 includes an upstanding post 26 on which a pivotal saw arm 28 is mounted for vertical movement, as seen by the solid and dash-line positions in FIG. 3. The pivotal mounting of the saw arm 28 on the post is intermediate its ends for appropriate balancing of the saw arm with a drive motor 30 being at the rear end and the saw blade unit 32 at the front end.

It is seen that the motor 30 is positioned horizontally and perpendicularly to the saw arm 28. As seen in FIG. 4, the motor is arranged on the opposite side of the saw arm from the blade unit 32 and air for cooling the motor is drawn into the motor through inlet openings in its outer end as indicated by the arrows 34. The air is circulated within the motor and then exhausted as indicated by the arrows 36 and is directed toward the saw arm 28 by an annular air vane 38. The exhaust air 36 also is directed toward the vertical plane containing the saw blade unit 32 and the dust particles 40, thus blowing the dust particles away from the motor 30 and in particular away from the inlet openings at the outer end of the motor 30 thus keeping the motor free from contamination.

The saw blade unit 32 inlcudes a conventional circular blade 42 mounted on a shaft 44 which extends through a bushing sleeve 46. Inside the saw arm 28 is a drive belt connecting the motor 30 to the shaft 44 for rotating the blade 42.

The saw blade 42 is protected by a top blade guard 48 and a bottom guard 50. The top guard 48 is mounted for pivotal movement about the axis of rotation of the blade 42 and is maintained in a level position by self-levelling linkage 54 extending between the guard 48 and the upstanding post 26.

The bottom guard 50 is shown in FIG. 2 to include opposite side walls 56 and 58 and end walls 60 and 62. The side wall 58 includes a cutout 64 to receive the bushing sleeve 46. The bottom guard 50 is pivotally mounted by the bolt 66 to the top guard 48 remotely of the pivotal axis of the top guard 48 through the axial center of the blade 42. The pivotal axis for the bottom guard 50 and the axial center of the blade 42 and the pivotal axis of the top guard 48 are in a common horizontal plane as seen in FIG. 3 and since the top guard 48 is self-levelling while the blade is raised and lowered, this relationship is maintained even though the bottom guard is raised and lowered relative to the top guard and the blade 42. It is further seen that the bottom blade guard 50 embraces the lower peripheral edge of the top guard 48 and is limited in its upwardly pivotal movement by the depth of the cutout 64 wherein the sleeve 46 will engage the bottom edge 80 of the cutout 64 after maximum upward pivotal movement has occurred.

The saw arm 28 is raised and lowered by operation of a foot lever 82 having a foot-engaging end 84. The lever 82 is limited in its upward travel by a vertically arranged stop 86 and the lever is pivoted at 88 on a shaft 90 extending between the rear legs 16 of the table 18. The lever 82 includes a rear portion 91 pivotally connected to an upstanding arm portion 92 connected to an upper arm portion 94 through a beveled gear box 96 for varying the length of the arm portions 92 and 94 for setting the position of the saw arm 28. The upper end of the arm portion 94 is connected to the rear end of the saw arm 28 and thus downward pivoting of the foot lever 84 to the dash-line position in FIG. 3 will cause the saw arm to move to its downward pivotal position, as shown by the dash lines in FIG. 3. A hand-operated crank 100 connected to a shaft 102 in turn connected to the beveled gear box 96 through a universal joint 104 adjusts the length of the vertically disposed arms 92 and 94 by a threaded bolt portion 106 being threadably received in the lower end of the arm portion 94.

The bottom blade guard 50 is raised and lowered by the operation of the foot lever 82. A cable 108 is connected by a turnbuckle 110 to the foot lever 82 between the foot plate 84 and the pivotal axis 88. The cable 108 extends upwardly over a pulley 112 mounted on the lower side of the tabletop 18 thence the cable extends rearwardly to the back side of the table over a pulley 114 and thence upwardly to pulley 116 positioned on an L-shaped bracket 118 connected to the post 26. Lastly, the cable 108 extends forwardly where it is finally anchored to a post 120 upstanding on the bottom guard 50 above its pivotal axis through the bolt 66 positioned in the holes 122 in the side walls 56 and 58 of the bottom guard 50.

A spring 124 is connected between the lower side of the table and the foot level 82 to normally maintain the saw arm in its raised position. Pressure on the foot lever 82 overcomes the tension in the spring 124 to cause the saw arm to be lowered.

In operation it is seen that with the saw arm 28 in its raised position the saw blade 42 is fully enclosed by the top blade guard 48 in the bottom guard 50. As the saw arm and blade are lowered by pressing down on the foot blade 84 the bottom guard 50 is automatically raised, as seen by the dash-line positions in FIG. 3 and thus the saw arm and the bottom blade guard move in opposite directions. As the saw arm is raised the bottom blade guard is lowered. Adjustments in the pivotal action of the bottom blade guard 50 may be made by varying the length of the cable 108 through operation of the turnbuckle 110. Once the adjustment is made no further adjustment should be required. It is thus further seen that operation of the bottom blade guard 50 is totally independent of the work piece being cut by the blade 42 and thus the bottom blade guard 50 need not ever touch the work piece since pivotal movement of the blade guard is controlled by the raising and lowering of the blade 42 automatically.

I claim:

1. A table saw comprising:

a table having an upstanding post on which a saw arm having a saw blade on its outer free end is pivotally mounted for pivotal movement between raised and lowered positions, a foot lever having a foot engaging end and an opposite end pivotally connected under said table to said table with the pivotal axis between said foot engaging end and said opposite end for vertical pivotal movement, an upstanding link connected at one end to said opposite end of said foot lever and at the other end to said saw arm on the opposite side of said saw arm pivotal axis from said saw blade such that said foot lever and said saw arm pivot in substantial parallel relationship to raise and lower the outer free end of said saw arm relative to said table whereby said saw blade on the outer free end of said saw arm moves towards and away from a work piece on said table, a blade guard having a top saw guard covering the top half of said saw blade pivotally connected to said saw arm and a bottom saw guard pivotally connected to said saw arm by being pivotally connected to said top guard for pivotal movement of said blade guard between raised and lowered positions relative to said saw blade with said blade being protected by said guard when said guard is in its lowered position and being exposed when in its raised position, leveling means connected between said saw arm and said top guard to maintain said top guard level as said saw arm is raised and lowered, and cable means connected to said foot lever between said pivotal axis of said foot lever and said foot engaging end and extending upwardly into engagement with said bottom guard at a point on the opposite side of said pivotal axis for said bottom saw guard from said saw blade such that said bottom guard pivots in a direction opposite to the pivotal movement of said saw arm relative to said table.

2. The structure of claim 2 wherein said table includes front and back sides and said cable means is further defined as extending upwardly from said foot lever then over a pulley and to the rear of said table thence over a second pulley and thence upwardly to over a third pulley on the rear end of said saw arm and thence forwardly into engagement with an upstanding element on said bottom guard.

3. The structure of claim 2 wherein said pivotal connection between said top and bottom saw guards is remotely located from the axial center of said saw blade.

4. The structure of claim 3 wherein said pivotal connection between said top and bottom saw guards is further defined as being in a common plane with said saw blade axial center and said common plane is substantially horizontal.

5. The structure of claim 4 wherein said top blade guard is pivotally connected to said saw arm for pivotal movement about an axis coaxial with said saw blade.

6. A table saw comprising, a table having an upstanding post on which a saw arm having a saw blade on its outer free end is pivotally mounted above said table for pivotal movement between raised and lowered positions, said saw blade having a top blade edge and a bottom blade edge, saw arm linkage means connected to said saw arm for raising and lowering the outer free end of said saw arm relative to said table whereby said saw blade on the outer free end of said saw arm is adapted to be moved towards and away from a work piece on said table.

a blade guard operatively connected to said saw arm for movement between raised and lowered positions relative to said saw blade with said bottom blade edge being completely enclosed by said guard when said guard is in its lowered position and being exposed when said guard is in its raised position, and blade guard actuating means connected between said blade guard and said saw arm linkage means to move said blade guard relative to said saw arm in a direction opposite to the pivotal movement of said saw relative to said table, such that said bottom edge is completely enclosed by said guard when said saw arm is in its raised position and is exposed when said arm is in its lowered position.

7. The structure of claim 6 wherein said arm includes a motor at one end of said arm extending horizontally and perpendicular to said arm and a vertically rotatable saw blade at the opposite end of said arm on the opposite side from said motor, and drive means connecting said motor to said saw blade, and said motor having inlet air openings at its end opposite said saw arm and outlet air openings between said arm and said inlet air openings with vane means positioned to direct said outlet air towards said arm and the vertical plane including said saw blade whereby sawdust thrown rearwardly by said saw blade is blown away from said motor inlet openings by air from said motor outlet openings.

8. The structure of claim 6 wherein said blade guard is pivotally connected to said saw arm for pivotal movement between said raised and lowered positions relative to said saw blade.

9. The structure of claim 8 wherein said blade guard is further defined as having a bottom guard element for said bottom blade edge and a top guard element pivotally connected to said saw arm for covering said top blade edge, said bottom guard element pivotally connected to said saw arm by being pivotally connected to said top guard element.

10. The structure of claim 9 wherein said pivotal connection between said top and bottom guard elements is remotely located from the axial center of said saw blade.

11. The structure of claim 10 wherein said pivotal connection between said top and bottom guard elements is further defined as being in a common plane with said saw blade axial center and said common plane is substantially horizontal.

12. The structure of claim 11 wherein leveling means is connected between said saw arm and said top guard element to maintain said top guard element level as said saw arm is raised and lowered.

13. The structure of claim 12 wherein said top guard element is pivotally connected to said saw arm for pivotal movement about an axis coaxial with said saw blade.

14. The structure of claim 13 wherein said saw arm linkage includes a foot lever positioned under said table and pivotally connected to said table for vertical pivotal movement, said foot lever includes a foot-engaging end and an opposite end connected to an upstanding link in turn connected to said saw arm on the opposite side of said saw pivotal axis from said saw blade and said foot lever pivotal axis is between said footengaging end and said opposite end whereby said foot lever and said saw arm are adapted to pivot in substantial parallel relationship.

15. The structure of claim 14 wherein said blade guard actuating means includes a cable means connected to said foot lever between said pivotal axis of said foot lever and said foot-engaging end and extending upwardly into engagement with said bottom guard element at a point on the opposite side of said pivotal axis for said bottom guard element from said bottom blade edge whereby said foot lever and said bottom guard element are adapted to move in opposite directions.

16. The structure of claim 15 wherein said table includes front and back sides and said cable means is further defined as extending upwardly from said foot lever then over a pulley and to the rear of said table thence over a second pulley and thence upwardly to over a third pulley on the rear end of said saw arm and thence forwardly into engagement with an upstanding element on said bottom guard element.

* * * * *